US007367818B2

(12) United States Patent
Sakamoto

(10) Patent No.: US 7,367,818 B2
(45) Date of Patent: May 6, 2008

(54) ONBOARD CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/472,320

(22) Filed: Jun. 22, 2006

(65) Prior Publication Data

US 2007/0015386 A1 Jan. 18, 2007

(30) Foreign Application Priority Data

Jul. 15, 2005 (JP) ..... P2005-207063

(51) Int. Cl.
*H01R 1/00* (2006.01)

(52) U.S. Cl. ..... 439/79; 439/607; 439/651.5

(58) Field of Classification Search ..... 439/79, 439/701, 541.5, 607
See application file for complete search history.

(56) References Cited

U.S. PATENT DOCUMENTS 6,863,545 B2 * 3/2005 Peloza ..... 439/79
2001/0023147 A1 9/2001 Kashiyama et al.
2002/0086580 A1 7/2002 Kurimoto et al.

FOREIGN PATENT DOCUMENTS

| | | | |
|---|---|---|---|
| JP | 05-85032 | U | 11/1993 |
| JP | 07-263069 | A | 10/1995 |
| JP | 10-021988 | A | 1/1998 |
| JP | 2003-257524 | A | 12/2003 |
| JP | 2004-206924 | A | 7/2004 |

* cited by examiner

*Primary Examiner*—Alexander Gilman
(74) *Attorney, Agent, or Firm*—Sughrue Mion, PLLC

(57) ABSTRACT

In an onboard connector 10, an outer housing 11 is fixed to a circuit board 22 in such a manner that external connection portions 36, 39, 42, 42 and 45, projecting from respective first, second, third, fourth and fifth inner housings 13, 15, 17, 19 and 21, are disposed within respective mating connector-fitting through holes 25 and 30. The first, second, third, fourth and fifth inner housings 13, 15, 17, 19 and 21 and the outer housing 11 are mounted on the circuit board 22 in such a manner that these inner housings are disposed out of contact with the inner housing.

3 Claims, 10 Drawing Sheets

ONBOARD CONNECTOR

BACKGROUND OF THE INVENTION

1. Field of the Invention

This invention relates to an onboard connector (in other words, a circuit board direct-mounting connector) having electrically-conductive metal terminals (hereinafter referred to merely as "terminals") received in a connector housing, these terminals being mounted on an electric circuit board (hereinafter referred to merely as "circuit board").

2. Description of the Related Art

In a vehicle such as an automobile, electrical equipment parts, mounted on the vehicle, are required to have a compact design in order to increase a space within a car room. Therefore, it is also required to reduce an area occupied by a circuit board (mounted as an electrical equipment part on the vehicle) in the vehicle. As one method of reducing the area of the board, it has now become necessary to use a SMD type (that is, a surface mounting type) onboard connector instead of a conventional DIP type (that is, a discrete type) onboard connector.

However, taking into consideration the connecting reliability of joined portions (that is, electrically-contacted portions) of terminals and respective lands of the circuit board against warp of the circuit board, it is rather difficult to use the SMD type onboard connector on the onboard circuit board which is required to have a high reliability under severe environments. And besides, in the case where this SMD type onboard connector is, for example, a multi-pole connector with a large number of terminals or a large-size connector having a large connector housing, it is more difficult to use the SMD type onboard connector on the onboard circuit board.

FIG. 11 shows one example of a structure of an electric part which has heretofore been proposed in order to enhance the connecting reliability of joined portions of terminals and respective lands (see JP-UM-A-5-85032 Publication). Description will now be made, assuming that the electric part, shown in FIG. 11, is an onboard connector. In this onboard connector 150, in order that soldier fillets, formed respectively at joined portions of a plurality of SMD type terminals 152 and respective lands on a circuit board 153, can be prevented from being broken by warp of the circuit board 153, a slit (not shown) is formed in a predetermined portion of each of the terminals 152 to divide this portion into a plurality of sections in a direction of a width of the terminal 152, and the divided sections are bent respectively in opposite directions to thereby enhance spring properties of the terminal 152. However, in the case where the onboard connector 150 is a multi-pole connector or a large-size connector, a larger number of terminals 152 are arranged long in a row in a juxtaposed manner, and therefore there is a strong possibility that this structure can not function well at all against warp of the circuit board 153 developing during reflowing. Namely, the larger the area, occupied by the onboard connector 150 on the circuit board 153, becomes, the more conspicuous the influence of the warp of the circuit board becomes.

FIG. 12 shows one conventional onboard connector in which the arrangement of a number of terminals is elaborated (see JP-A-2004-206924 Publication). In FIG. 12, constituent elements, similar to those of the structure of FIG. 11, are designated respectively by identical reference numerals for clarification purposes. In this onboard connector 150, the plurality of SMD type terminals 152 are divided into two groups in a direction of a width of a connector housing 151 to thereby achieve a narrow pitch design as shown in FIG. 12. However, the plurality of terminals 152 are arranged at a small pitch along the connector housing, and also the front row of terminals 152 and the rear row of terminals 152 are arranged in overlapping relation to each other, and therefore joined portions of the terminals and respective lands can not be easily examined. And besides, the onboard connector 150 of FIG. 12 has such a structure that inner housings 155 are received in respective front openings 154 in the connector housing 151, and therefore if the connector housing 151 is wrenched by a mating connector when fitting the mating connector to the onboard connector 150, an external force from the mating connector acts directly on the terminals 152, so that the connecting reliability of the joined portions of the terminals and the respective lands is lowered.

SUMMARY OF THE INVENTION

This invention has been made in view of the above circumstances, and an object of the invention is to provide an onboard connector in which particularly, the connecting reliability of electrically-contacted portions of terminals and a circuit board can be enhanced.

The above object has been achieved by an onboard connector of the present invention recited in the following Paragraphs (1) to (3).

(1) An onboard connector comprising:

a plurality of terminals each having an external connection portion and a board connection portion;

at least one inner housing receiving the plurality of terminals, with the external connection portions and the board connection portions exposed; and a frame-like outer housing having a mating connector-fitting through hole; characterized in that:

the onboard connector is mounted on a circuit board; and the at least one inner housing is fixed to the circuit board in such a manner that the board connection portions are electrically connected to the circuit board; and the outer housing is fixed to the circuit board in such a manner that the mating connector-fitting through hole is disposed in registry with the external connection portions exposed from the at least one inner housing; and the at least one inner housing and the outer housing are mounted on the circuit board in such a manner that the inner housing and the outer housing are disposed out of contact with each other.

(2) The onboard connector of the above Paragraph (1) is further characterized in that the outer housing is fixed to the circuit board in such a manner that the external connection portions, projecting from the at least one inner housing, are disposed within the mating connector-fitting through hole.

(3) The onboard connector of the above Paragraph (1) or Paragraph (2) is further characterized in that the board connection portions of the terminals are formed into a surface-mounting type so as to be mounted on a surface of the circuit board.

In the onboard connector of the above Paragraph (1), the outer housing is fixed to the circuit board in such a manner that the mating connector-fitting through hole is disposed in registry with the external connection portions exposed from the at least one inner housing, and the at least one inner housing and the outer housing are mounted on the circuit board in such a manner that the inner housing and the outer housing are disposed out of contact with each other. Terminals (that is, mating terminals) of a mating connector, fitted in the mating connector-fitting through hole in the outer housing, contact the external connection portions, respectively, and are electrically connected thereto.

Here, even if the outer housing is wrenched by the mating connector when fitting the mating connector into the onboard connector of the above Paragraph (1), an undesirable external force, applied from the mating connector to the outer housing, will not act on the terminals of the onboard connector of the above Paragraph (1), since the at least one inner housing and the outer housing are mounted on the circuit board in such a manner that the inner housing and the outer housing are disposed out of contact with each other (that is, will not interfere with each other).

Therefore, only a pure inserting force or a pure withdrawing force, produced when properly inserting or withdrawing the mating connector, acts on the board connection portions of the terminals of the onboard connector of the above Paragraph (1). Thus, in the onboard connector of the above Paragraph (1), the connecting reliability of the electrically-contacted portions of the terminals and circuit board can be enhanced.

And besides, in the onboard connector of the above Paragraph (1), the at least one inner housing and the outer housing are disposed out of contact with each other, and in other words the inner housing and the outer housing are formed as separate members, respectively, and therefore the board connection portions of the terminals, exposed from the at least one inner housing, can be disposed also between the inner housing and the outer housing, and therefore regions where the electrically-contacted portions of the board connection portions and circuit board can be examined can be increased. Therefore, the terminals can be arranged in a high-density pattern.

In the onboard connector of the above Paragraph (1), preferably, a plurality of inner housings of a small size, each receiving a small number of terminals with external connection portions and board connection portions exposed, are fixed to the circuit board in such a manner that these inner housings are juxtaposed along the onboard connector, and are spaced from one another. Further, mating connector-fitting through holes, corresponding to these inner housings, are formed in the outer housing. In the onboard connector of this construction, even if the circuit board is warped under the influence of a temperature change, adverse effects of the warp of the circuit board are reduced as compared with a single multi-pole connector or a large-size connector, since each of the inner housings has the small size.

Therefore, in the onboard connector of the above Paragraph (1), the terminals can be easily formed into a multi-pole design.

As in the onboard connector of the above Paragraph (2), the outer housing is fixed to the circuit board in such a manner that the external connection portions, projecting from the at least one inner housing, are disposed within the mating connector-fitting through hole. With this construction, the connection of the onboard connector to the mating connector can be effected more smoothly, and therefore this is desirable.

Preferably, the board connection portions of the terminals are formed into a surface-mounting type so as to be mounted on a surface of the circuit board as in the onboard connector of the above Paragraph (3).

The external connection portions of the terminals, used in the onboard connector of the invention, may be formed into either of the male type and the female type. In the onboard connector of the invention, the external connection portions and board connection portions of the terminals are exposed from the inner housing, and the term "exposed" means that these portions can be viewed from the outside of the inner housing, and even in the case where the external connection portions of the terminals, used in the onboard connector of the invention, are of the female type, and are disposed within the inner housing, the external connection portions are exposed through respective insertion holes which are formed in the inner housing for the insertion of mating male terminals.

In the present invention, the connecting reliability of the electrically-contacted portions of the terminals and circuit board can be enhanced.

DESCRIPTION OF THE PREFERED EMBODIMENTS

The present invention has been briefly described above. Details of the invention will become more manifest upon reading the following Section "Best Mode for Carrying Out the Invention" with reference to the accompanying drawings.

A preferred embodiment of the present invention will now be described in detail with reference to the drawings.

Figure 1:
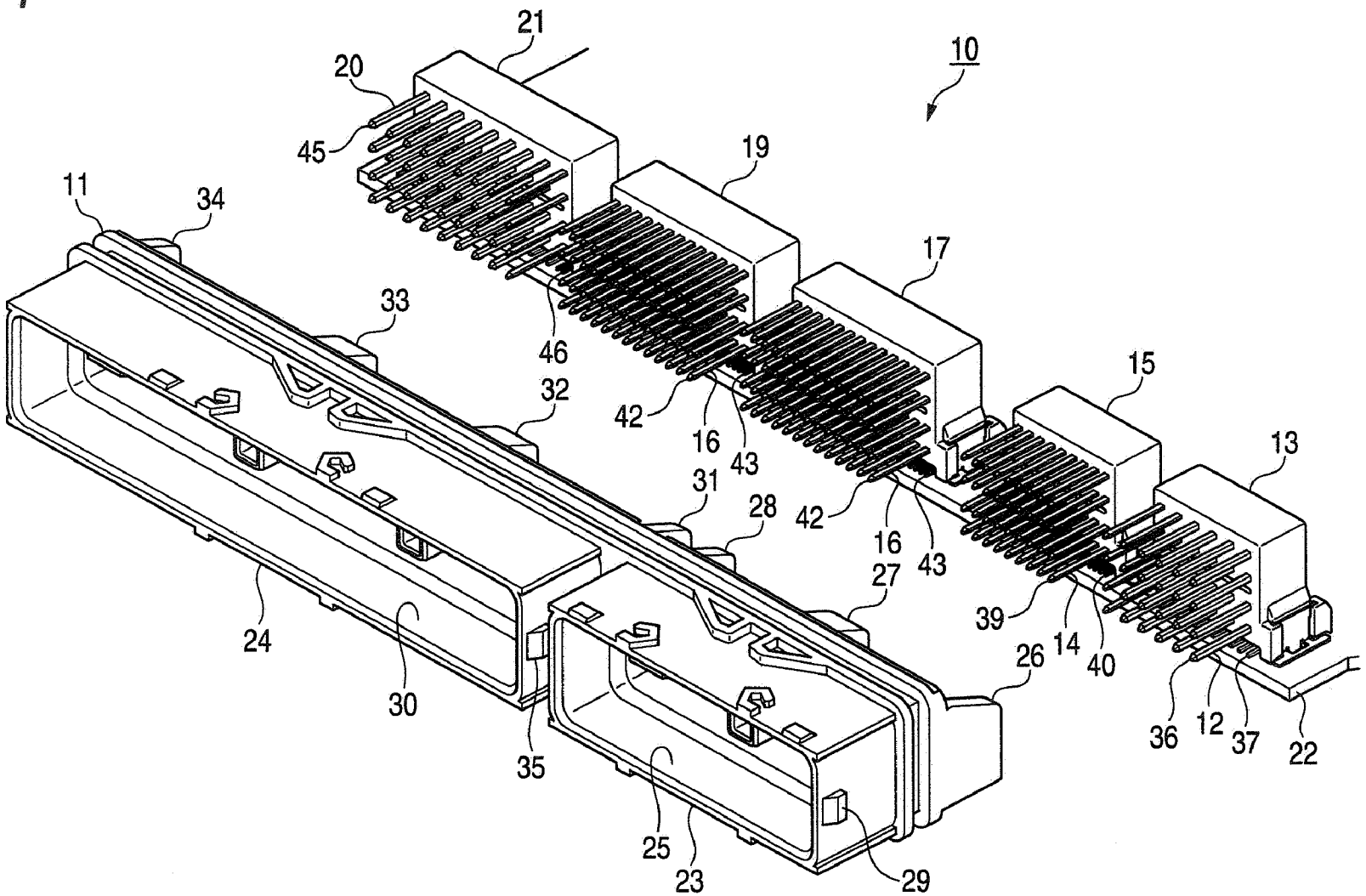
FIG. 1 is an exploded, perspective view showing an outer housing and a plurality of inner housings (mounted on a circuit board) which are used in one preferred embodiment of an onboard connector of the invention.
Figure 2:
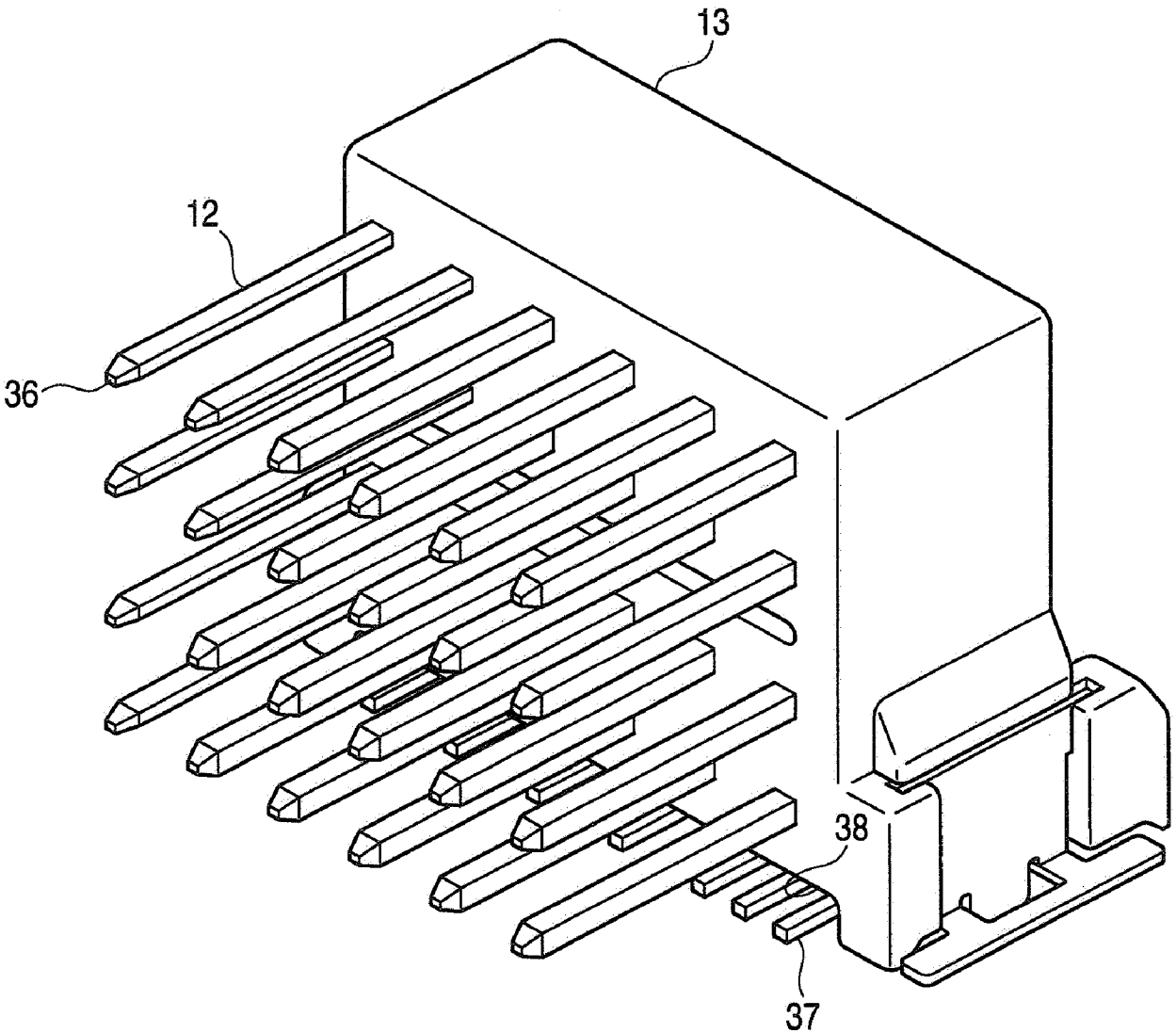
FIG. 2 is a perspective view of the first inner housing of FIG. 1, showing its appearance.
Figure 3:
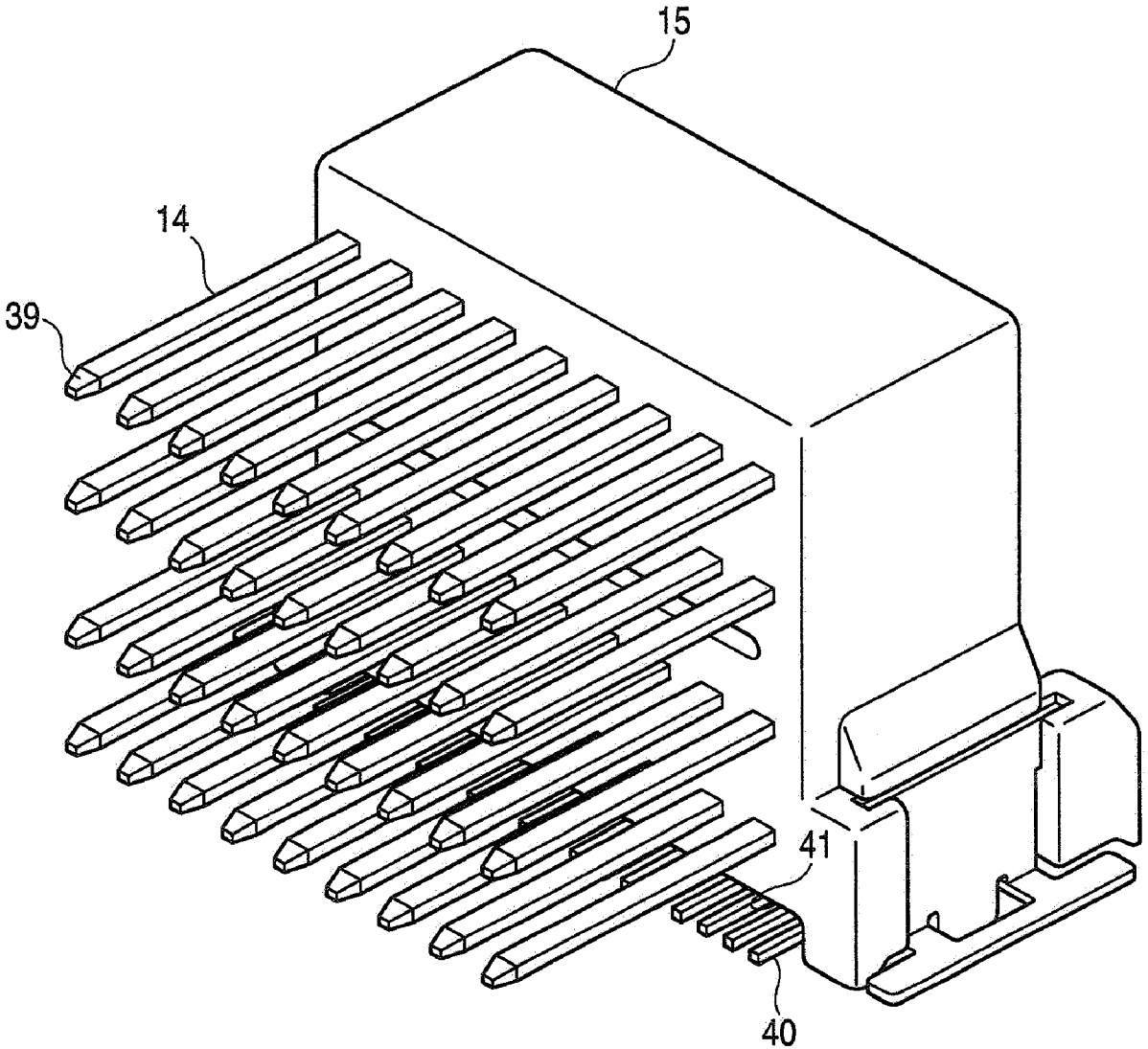
FIG. 3 is a perspective view of the second inner housing of FIG. 1, showing its appearance.
Figure 4:
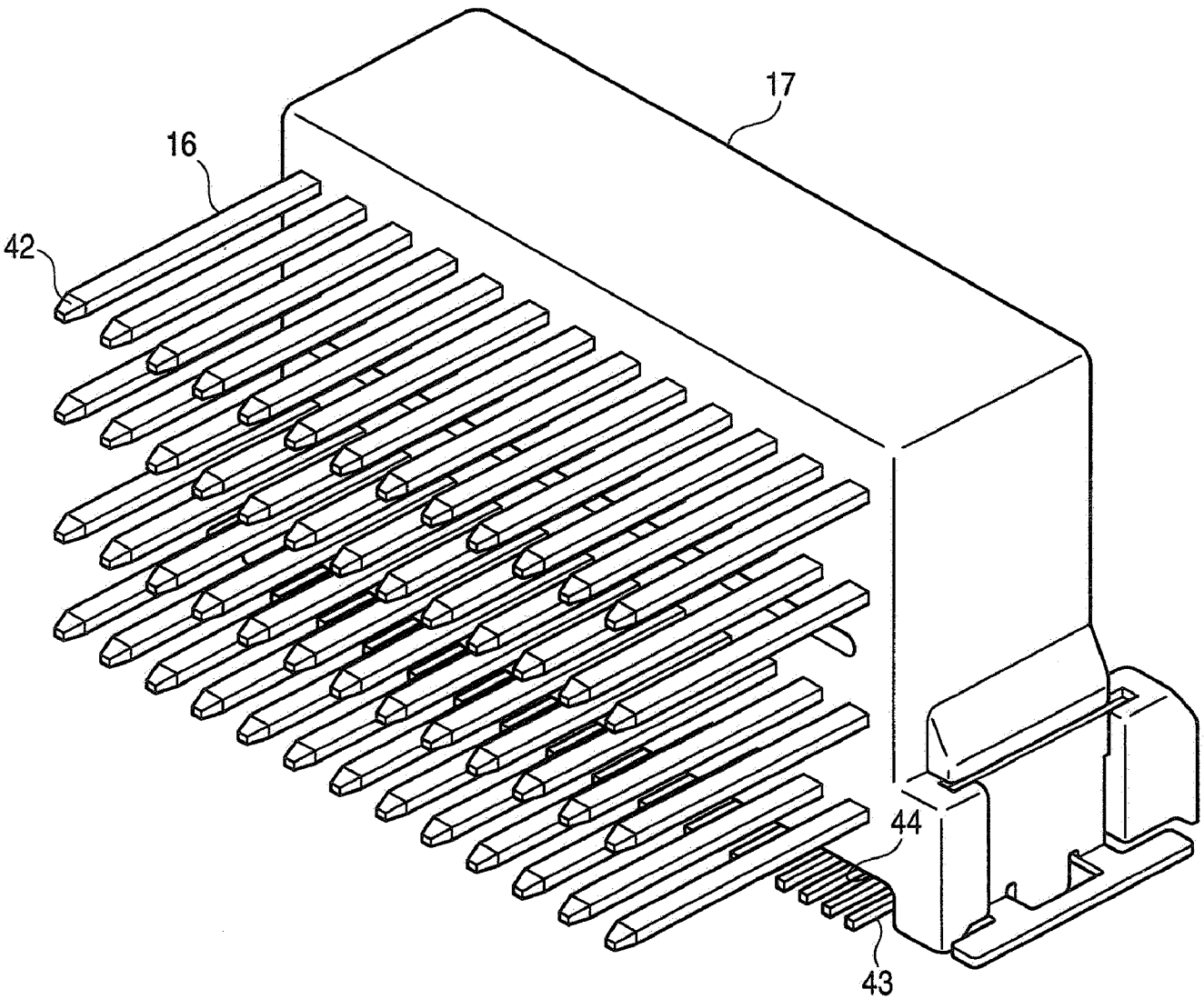
FIG. 4 is a perspective view of the third inner housing (which is similar to the fourth inner housing), showing its appearance.
Figure 5:
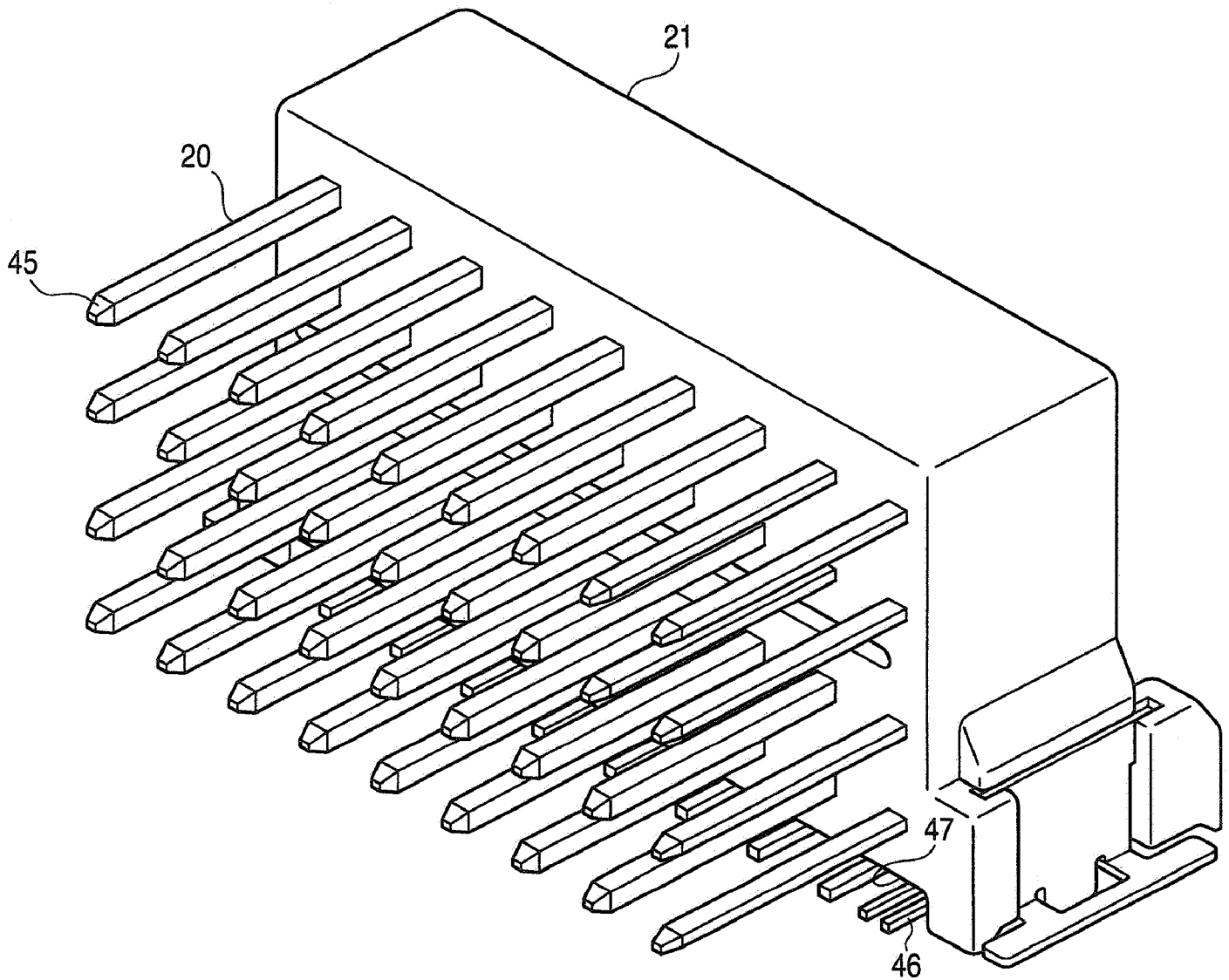
FIG. 5 is a perspective view of the fifth inner housing, showing its appearance.
Figure 6:
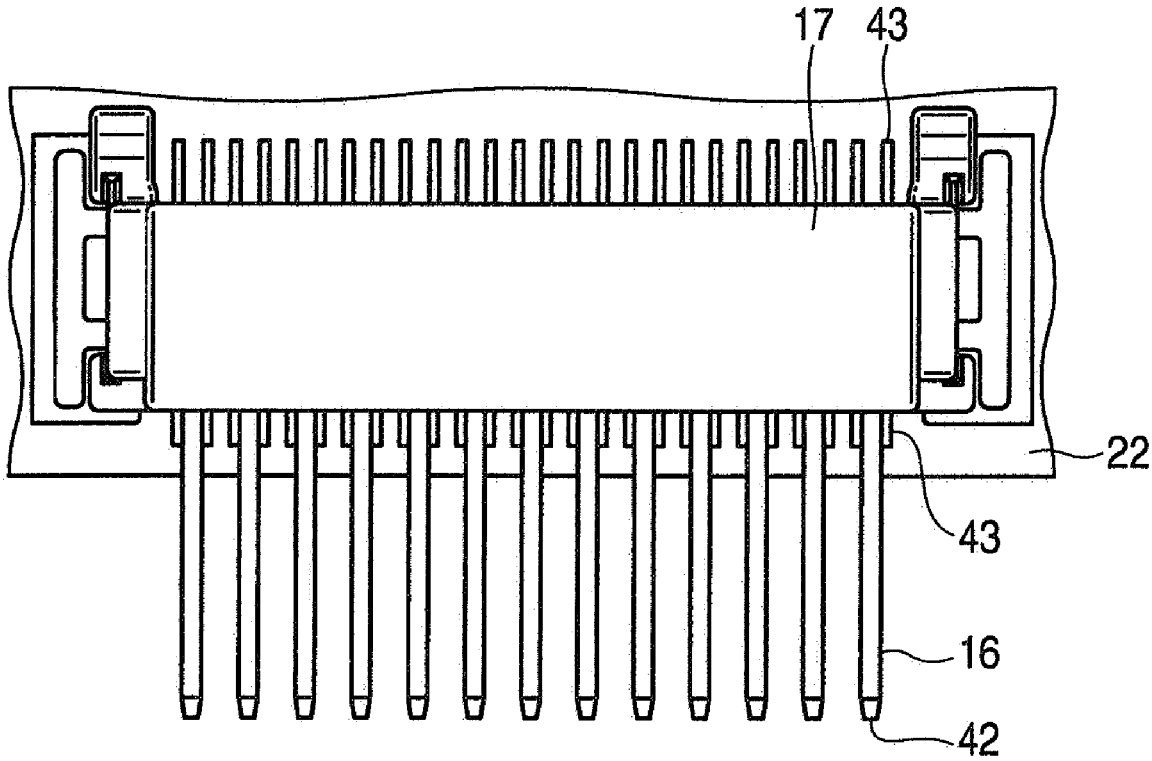
FIG. 6 is a plan view of the third inner housing of FIG. 1.
Figure 7:
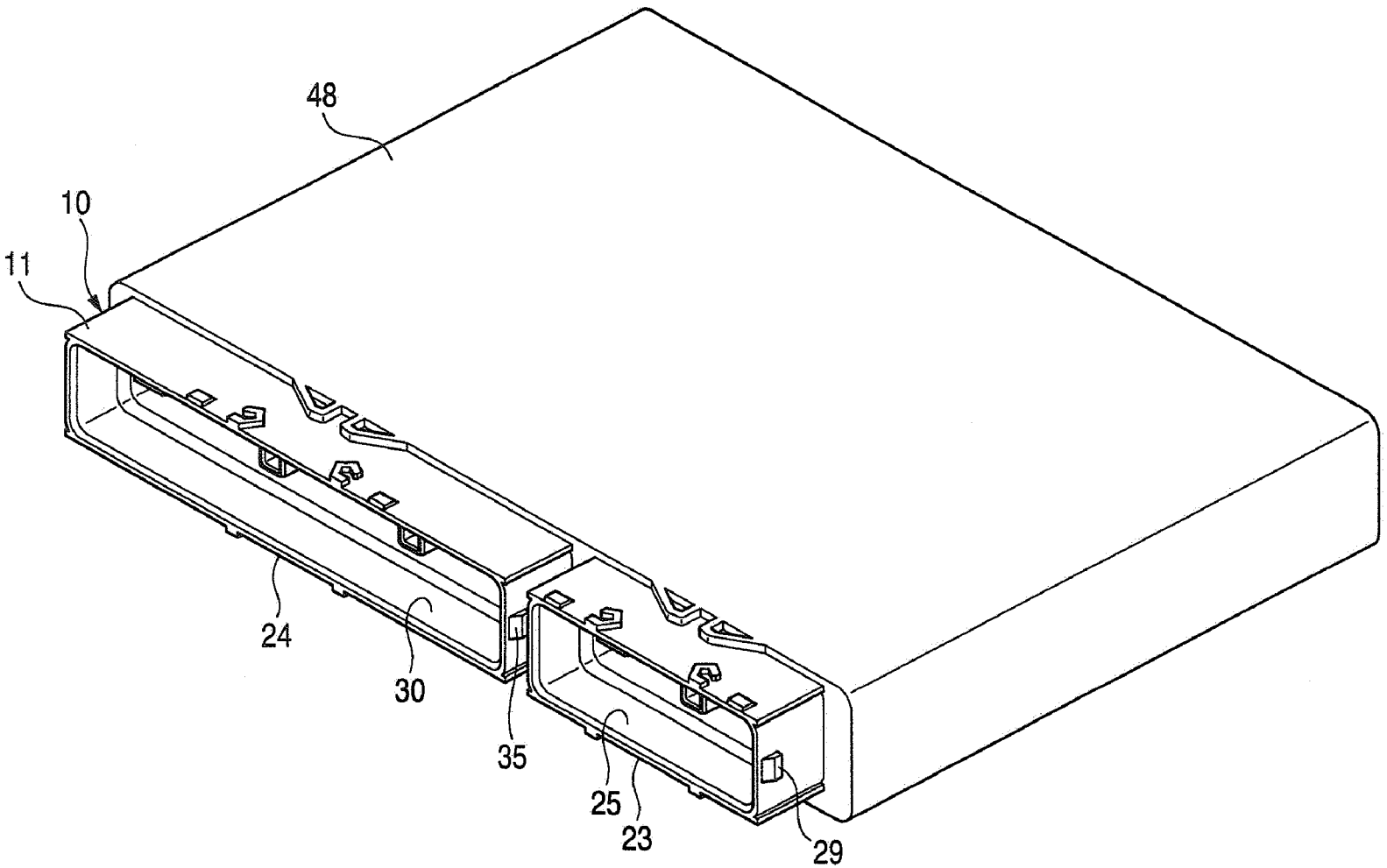
FIG. 7 is a perspective view of the preferred embodiment of the onboard connector of the invention, showing the whole thereof except external connection portions of terminals.
Figure 8:
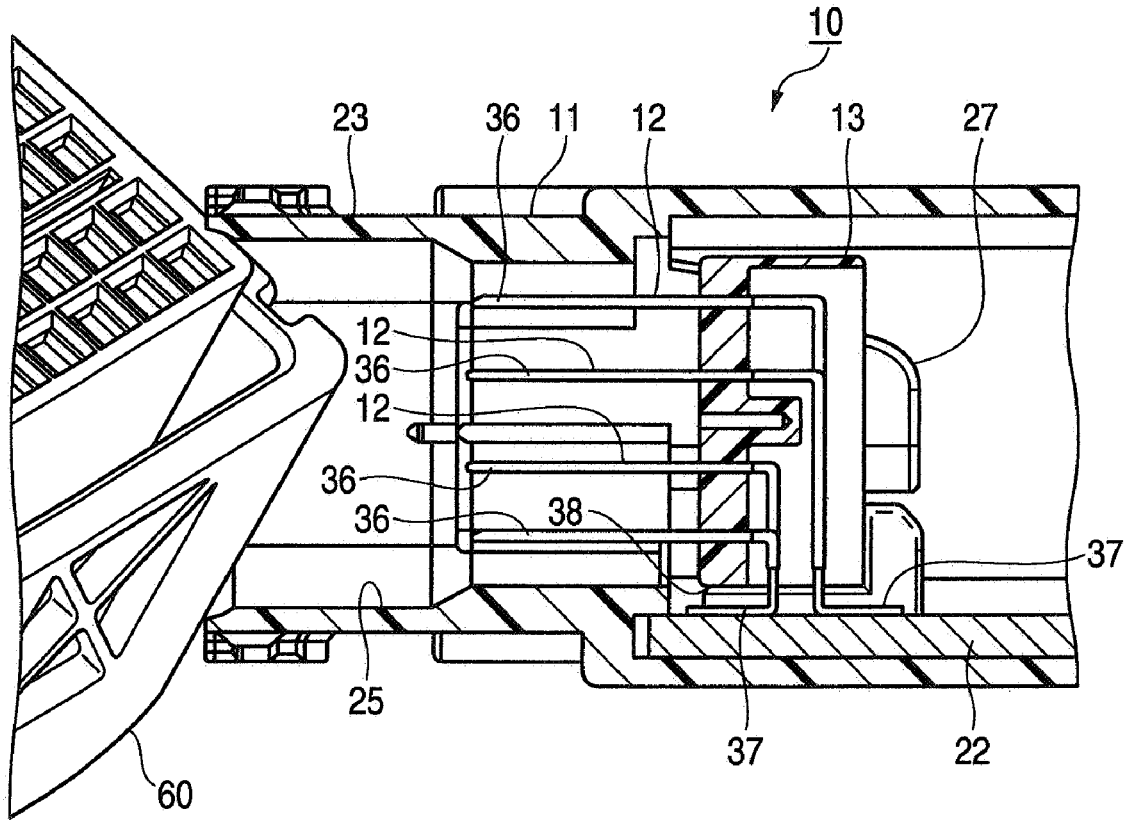
FIG. 8 is a cross-sectional view showing the assembled onboard connector of FIG. 1.
Figure 9:
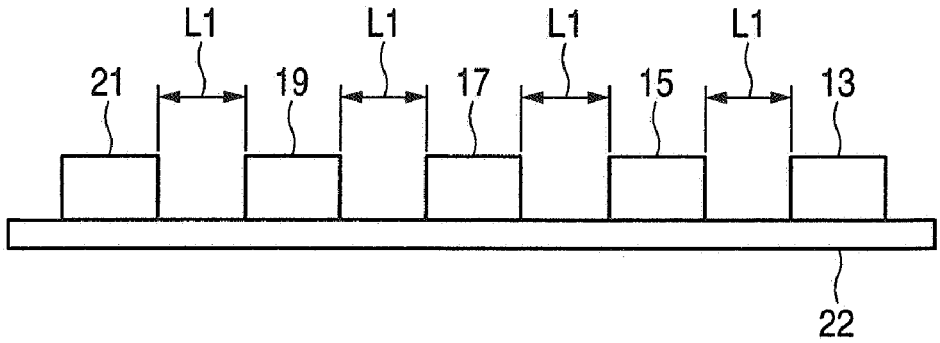
FIG. 9 is a schematic front-elevational view of the inner housings of FIG. 1 mounted on the circuit board.
Figure 10:
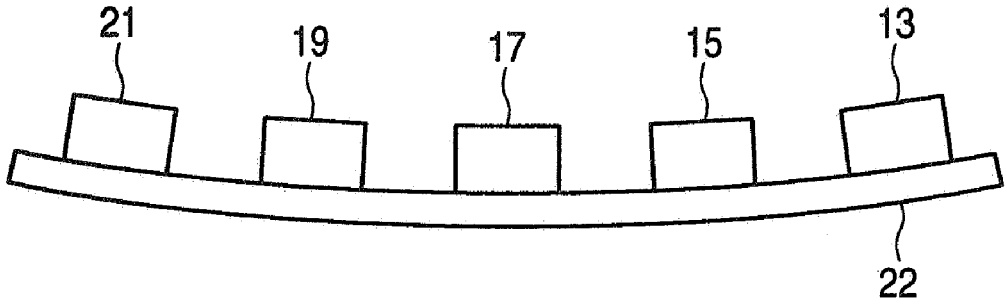
FIG. 10 is a schematic front-elevational view showing a condition in which warp develops in the circuit board of FIG. 9.
Figure 11:
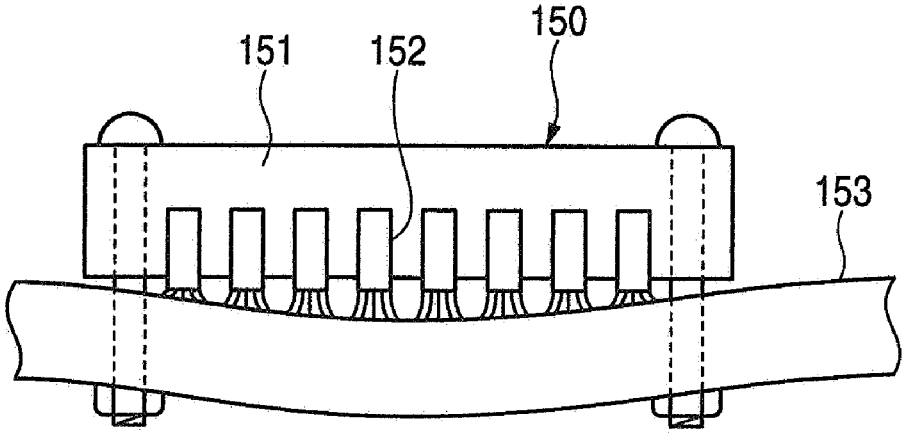
FIG. 11 is a front-elevational view of a conventional example.
Figure 12:
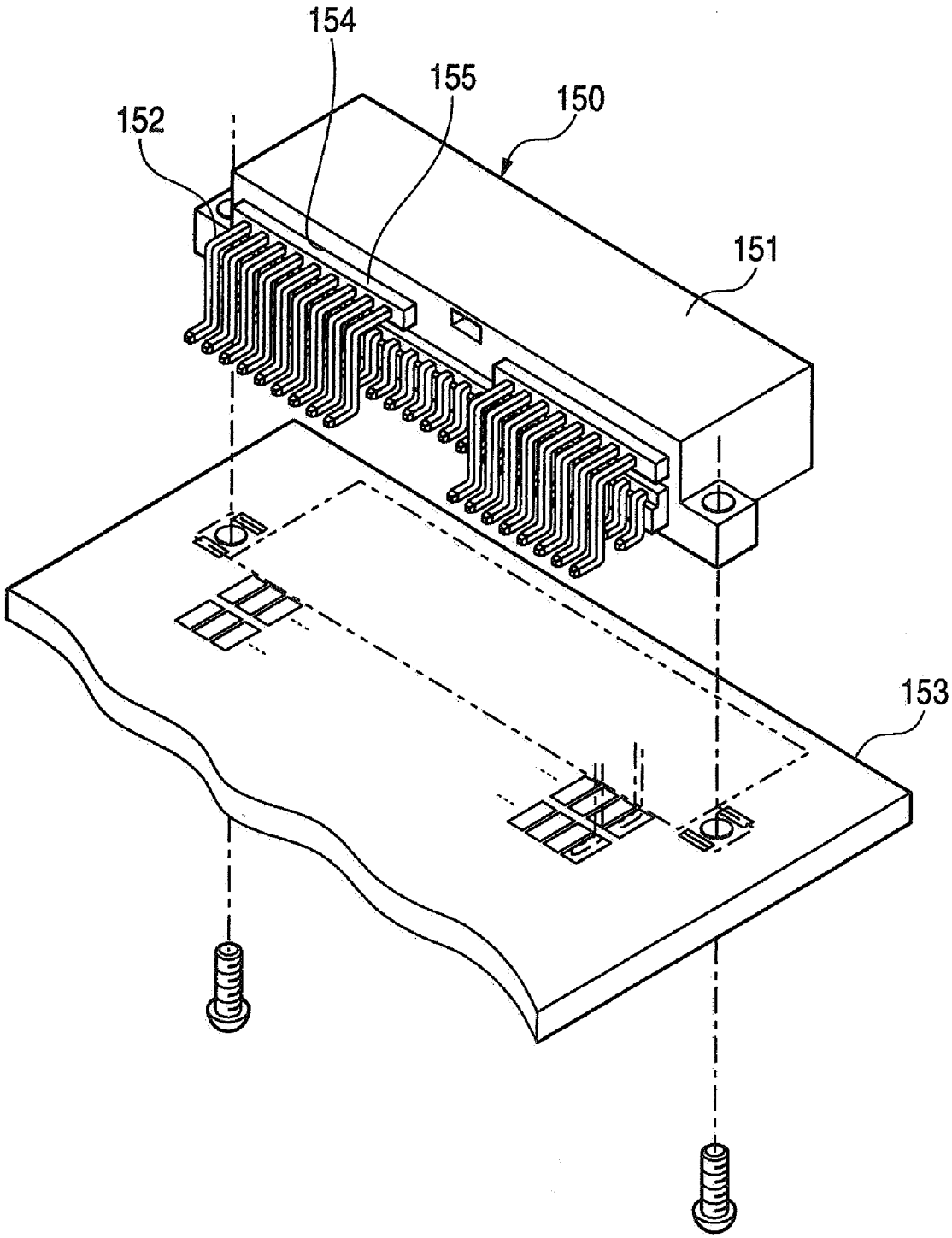
FIG. 12 is a perspective view of a conventional onboard connector, showing its appearance.

FIG. 1 is an exploded, perspective view showing an outer housing and a plurality of inner housings (mounted on a circuit board) used in one preferred embodiment of an onboard connector of the invention, FIG. 2 is a perspective view of the first inner housing of FIG. 1, showing its appearance, FIG. 3 is a perspective view of the second inner housing of FIG. 1, showing its appearance, FIG. 4 is a perspective view of the third inner housing (which is similar to the fourth inner housing), showing its appearance, FIG. 5 is a perspective view of the fifth inner housing, showing its appearance, FIG. 6 is a plan view of the third inner housing of FIG. 1, FIG. 7 is a perspective view of the preferred embodiment of the onboard connector of the invention, showing the whole thereof except external connection portions of terminals, FIG. 8 is a cross-sectional view showing the assembled onboard connector of FIG. 1, FIG. 9 is a schematic front-elevational view of the inner housings of FIG. 1 mounted on the circuit board, and FIG. 10 is a schematic front-elevational view showing a condition in which warp develops in the circuit board of FIG. 9.

As shown in FIG. 1, the onboard connector 10 of this embodiment comprises a plurality of groups of terminals (that is, surface mounting terminals) 12, 14, 16, 16 and 20 having respective male external connection portions 36, 39, 42, 42 and 45 and respective surface-mounting board connection portions 37, 40, 43, 43 and 46, the plurality of inner housings 13, 15, 17, 19 and 21 respectively receiving the groups of terminals 12, 14, 16, 16 and 20 with the external connection portions 36, 39, 42, 42 and 45 and the board connection portions 37, 40, 43, 43 and 46 exposed, and a frame-like outer housing 11 having mating connector-fitting through holes 25 and 30. This onboard connector 10 is mounted on the circuit board 22.

The inner housings 13, 15, 17, 19 and 21 are fixed to the circuit board 22 in such a manner that the board connection portions 37, 40, 43, 43 and 46 are electrically connected to the circuit board 22.

The outer housing 11 is fixed to the circuit board 22 in such a manner that the mating connector-fitting through holes 25 and 30 are disposed in registry with the corresponding external connection portions 36, 39, 42, 42 and 45 exposed from the respective inner housings 13, 15, 17, 19 and 21. More specifically, the outer housing 11 is fixed to the circuit board 22 in such a manner that the external connection portions 36, 39, 42, 42 and 45, exposed from the respective inner housings 13, 15, 17, 19 and 21, are disposed within the corresponding mating connector-fitting through holes 25 and 30

Press-fitting portions 22*a* are formed on and project respectively from opposite side surfaces of one end portion (to which the inner housings 13, 15, 17, 19 and 21 are fixed) of the circuit board 22, and when the one end portion of the circuit board 22 is press-fitted into a board end portion-receiving chamber within the outer housing 11, the press-fitting portions 22*a* are pressed and held against an inner wall surface of the outer housing 11, thereby fixing the outer housing 11 to the circuit board 22. Instead of this fixing means, fixing members such as screws can be used for fixing the outer housing 11 to the circuit board 22. As is clear from FIG. 8, the inner housings 13, 15, 17, 19 and 21 and the outer housing 11 are mounted on the circuit board 22 in such a manner that the inner housings 13, 15, 17, 19 and 21 are disposed out of contact with the outer housing 11.

Details of the onboard connector 10 of the above construction will be described below.

As shown in FIG. 1, the onboard connector 10 comprises the first inner housing 13 holding the plurality of terminals 12, the second inner housing 15 holding the plurality of terminals 14, the third inner housing 17 holding the plurality of terminals 16, the fourth inner housing 19 holding the plurality of terminals 16, and the fifth inner housing 21 holding the plurality of terminals 20.

The outer housing 11 is molded of an insulative synthetic resin, and a first hood portion 23, corresponding to the first and second inner housings 13 and 15, and a second hood portion 24, corresponding to the third, fourth and fifth inner housings 17, 19 and 21, are formed integrally with a body of the outer housing 11.

The first hood portion 23 has a generally rectangular frame-shape. The mating connector-fitting through hole 25 is defined by an inner peripheral surface of the first hood portion 23 which serves to guide a mating connector 60 (see FIG. 8) fitted into the first hood portion 23 from the front side thereof. The first hood portion 23 has first, second and third guide plates 26, 27 and 28 formed on and projecting from a rear surface thereof. The first hood portion 23 also has engagement projections 29 (for engagement with the mating connector 60) formed respectively on opposite side surfaces thereof.

The second hood portion 24 has a generally rectangular frame shape, and is larger in length than the first hood portion 23. The mating connector-fitting through hole 30 is defined by an inner peripheral surface of the second hood portion 24 which serves to guide a mating connector (not shown) fitted into the second hood portion 24 from the front side thereof. The second hood portion 24 has fourth, fifth, sixth and seventh guide plates 31, 32, 33 and 34 formed on and projecting from a rear surface thereof. The second hood portion 24 also has engagement projections 35 (for engagement with the mating connector (not shown)) formed respectively on opposite side surfaces thereof.

The first inner housing 13 is molded into a generally square shape, using an insulative synthetic resin, and has 24 terminals 12 arranged in a pattern of 6×4.

The second inner housing 15 is molded into a generally square shape, using an insulative synthetic resin, and has 36 terminals 14 arranged in a pattern of 9×4.

The third inner housing 17 is molded into a generally square shape, using an insulative synthetic resin, and has 52 terminals 16 arranged in a pattern of 13×4.

The fourth inner housing 19 has the same construction as that of the third inner housing 17, and has 52 terminals 16 arranged in a pattern of 13×4.

The fifth inner housing 21 is molded into a generally square shape, using an insulative synthetic resin, and has 36 terminals 20 arranged in a pattern of 9×4.

The first, second, third, fourth and fifth inner housings 13, 15, 17, 19 and 21 are mounted on the one end portion of the circuit board 22, and are arranged in a row at predetermined intervals along one end edge of the circuit board 22.

As shown in FIG. 2, the external connection portions 36 of the terminals 12 project forwardly from the first inner housing 13, and the board connection portions 37 of 12 terminals 12 are disposed in a recess portion 38 formed in a lower end of the first inner housing 13, and project forwardly from the recess portion 38 in parallel relation to one another, while the board connection portions 37 of the other 12 terminals 12 are disposed in the recess portion 38, and project rearwardly from the recess portion 38 in parallel relation to one another. The board connection portions 37 are electrically connected by soldering to respective lands (not shown) of an electric circuit pattern (made of electrically-conductive metal) formed on the circuit board 22.

As shown in FIG. 3, the external connection portions 39 of the terminals 14 project forwardly from the second inner housing 15, and the board connection portions 40 of 18 terminals 14 are disposed in a recess portion 41 formed in a lower end of the second inner housing 15, and project forwardly from the recess portion 41 in parallel relation to one another, while the board connection portions 40 of the other 18 terminals 14 are disposed in the recess portion 41, and project rearwardly from the recess portion 41 in parallel relation to one another. The board connection portions 40 are electrically connected by soldering to respective lands (not shown) of the electric circuit pattern (made of electrically-conductive metal) formed on the circuit board 22.

As shown in FIG. 4, the external connection portions 42 of the terminals 16 project forwardly from the third inner housing 17, and the board connection portions 43 of 26 terminals 16 are disposed in a recess portion 44 formed in a lower end of the third inner housing 17, and project forwardly from the recess portion 44 in parallel relation to one another, while the board connection portions 43 of the other 26 terminals 16 are disposed in the recess portion 44, and project rearwardly from the recess portion 44 in parallel relation to one another. The board connection portions 43 are electrically connected by soldering to respective lands (not shown) of the electric circuit pattern (made of electrically-conductive metal) formed on the circuit board 22.

The fourth inner housing 19 is identical in construction to the third inner housing 17, and therefore explanation thereof is omitted here (see FIG. 4 for reference).

As shown in FIG. 5, the external connection portions 45 of the terminals 20 project forwardly from the fifth inner housing 21, and the board connection portions 46 of 18 terminals 20 are disposed in a recess portion 47 formed in a lower end of the fifth inner housing 21, and project forwardly from the recess portion 47 in parallel relation to one another, while the board connection portions 46 of the other 18 terminals 20 are disposed in the recess portion 47, and project rearwardly from the recess portion 47 in parallel relation to one another. The board connection portions 46 are electrically connected by soldering to respective lands (not shown) of the electric circuit pattern (made of electrically-conductive metal) formed on the circuit board 22.

As representatively shown in FIG. 6, two board connection portions 43 can be seen through a gap between any two adjacent external connection portions 42, and therefore solder fillets at joined portions of the board connection portions 43 and respective lands on the circuit board 22 can be easily examined. The positional relation between the external connection portions and the board connection portions, similar to that of the third inner housing 17, is also established with respect to the first, second, fourth and fifth inner housings 13, 15, 19 and 21, and therefore solder fillets at joined portions of the board connection portions and respective lands on the circuit board 22 can be easily examined.

As shown in FIG. 7, the outer housing 11 is provided with a separate cover 48, and when the circuit board 22, having the first, second, third, fourth and fifth inner housings 13, 15, 17, 19 and 21 mounted thereon, is inserted into the outer housing 11 (having the cover 48 attached thereto) from the rear side, the whole of the circuit board 22 is received within the outer housing 11 and the cover 48. At this time, the first inner housing 13 is inserted between the first and second guide plates 26 and 27 of the first hood portion 23, and the second inner housing 15 is inserted between the second and third guide plates 27 and 28 of the first hood portion 23. Also, the third inner housing 17 is inserted between the fourth and fifth guide plates 31 and 32 of the second hood portion 24, and the fourth inner housing 19 is inserted between the fifth and sixth guide plates 32 and 33 of the second hood portion 24, and the fifth inner housing 21 is inserted between the sixth and seventh guide plates 33 and 34 of the second hood portion 24.

As representatively shown in FIG. 8, the first inner housing 13, having the board connection portions 37 electrically connected to the respective lands (not shown) on the circuit board 22, is mounted relative to the outer housing 11 in non-contact relation thereto (that is, the first inner housing 13 is disposed out of contact with the outer housing 11). The positional relation between each of the second, third, fourth and fifth inner housings 15, 17, 19 and 21 and the outer housing 11 is similar to the positional relation between the first inner housing 13 and the outer housing 11.

The first, second, third, fourth and fifth inner housings 13, 15, 17, 19 and 21 are arranged along the one end edge of the circuit board 22, and are spaced a predetermined distance L1 from one another as shown in FIG. 9.

Even if warp develops in the circuit board 22 during reflowing as shown in FIG. 10, the first, second, third, fourth and fifth inner housings 13, 15, 17, 19 and 21, the influence of the warp, developing in the circuit board 22, can be reduced since the first, second, third, fourth and fifth inner housings 13, 15, 17, 19 and 21 are spaced the predetermined distance of L1 from one another, and besides have the small widths, respectively. Therefore, lift-off, developing in the solder fillets formed respectively at the joined portions of the terminals 12, 14, 16, 16 and 20 and respective lands on the circuit board 22, can be reduced, and also solder cracks can be reduced.

As described above, in the onboard connector 10, the outer housing 11 is fixed to the circuit board 22 in such a manner that the external connection portions 36, 39, 42, 42 and 45, projecting from the respective first, second, third, fourth and fifth inner housings 13, 15, 17, 19 and 21, are disposed within the respective mating connector-fitting through holes 25 and 30, and besides the first, second, third, fourth and fifth inner housings 13, 15, 17, 19 and 21 and the outer housing 11 are mounted on the circuit board 22 in such a manner that these inner housings and the outer housing are disposed out of contact with each other. Terminals (that is, mating terminals) of the mating connector 60 and the other mating connector (not shown), fitted respectively in the mating connector-fitting through holes 25 and 30 in the outer housing 11, contact the respective external connection portions 36, 39, 42, 42 and 45, and are electrically connected thereto.

Here, even if the outer housing 11 is wrenched by the mating connector (for example, the mating connector 60) when fitting the mating connector 60 into the onboard connector 10, an undesirable external force, applied from the mating connector 60 to the outer housing 11, will not act on the plurality of terminals 12, 14, 16, 16 and 20 of the onboard connector 10, since the first and second inner housings 13 and 15 and the outer housing 11 are mounted on the circuit board 22 in such a manner that these inner housings and the outer housing are disposed out of contact with each other (that is, will not interfere with each other).

Therefore, only a pure inserting force or a pure withdrawing force, produced when properly inserting or withdrawing the mating connector 60 or the other mating connector, acts on the board connection portions 37, 40, 43, 43 and 46 of the terminals 12, 14, 16, 16 and 20 of the on-board connector 10. Thus, in the onboard connector 10, the connecting reliability of the electrically-contacted portions of the terminals 12, 14, 16, 16 and 20 and circuit board 22 can be enhanced.

And besides, in the onboard connector 10, the first, second, third, fourth and fifth inner housings 13, 15, 17, 19 and 21 are disposed out of contact with the outer housing 11, and in other words these inner housings are separate from the outer housing, and therefore the board connection portions 37, 40, 43, 43 and 46 of the terminals 12, 14, 16, 16 and 20, exposed from the respective first, second, third, fourth and fifth inner housings 13, 15, 17, 19 and 21, can be disposed also between the respective first, second, third, fourth and fifth inner housings 13, 15, 17, 19 and 21 and the outer housing 11, and therefore regions where the electrically-contacted portions of the board connection portions 37, 40, 43, 43 and 46 and circuit board 22 can be examined can be increased. Therefore, the terminals 12, 14, 16, 16 and 20 can be arranged in a high-density pattern.

In the onboard connector 10, the first, second, third, fourth and fifth inner housings 13, 15, 17, 19 and 21 of a small size, receiving the respective terminals with the external connection portions 36, 39, 42, 42 and 45 and the board connection portions 37, 40, 43, 43 and 46 exposed, are fixed to the circuit board 22 in such a manner that these inner housings are juxtaposed along the onboard connector, and are spaced from one another. Further, the mating connector-fitting through holes 25 and 30, corresponding to the first, second, third, fourth and fifth inner housings 13, 15, 17, 19 and 21, are formed in the outer housing 11. With this construction, even if the circuit board 22 is warped under the influence of a temperature change, the adverse effects of the warp of the circuit board 22 are reduced as compared with a single multi-pole connector or a large-size connector, since each of the first, second, third, fourth and fifth inner housings 13, 15, 17, 19 and 21 has the small size.

Therefore, in the onboard connector 10, the terminals can be easily formed into a multi-pole design.

The present invention is not limited to the above embodiment, and suitable modifications, improvements and so on can be made. The material, shape, dimensions, numeral value, form, number, disposition, etc., of each of the constituent elements of the above embodiment are arbitrary, and are not limited in so far as the invention can be achieved.

For example, although the external connection portions 36, 39, 42, 42 and 45 of the terminals 12, 14, 16, 16 and 20, used in the onboard connector 10, are of the male type, they may be of the female type.

In the onboard connector 10, the external connection portions 36, 39, 42, 42 and 45 and the board connection portions 37, 40, 43, 43 and 46 of the terminals 12, 14, 16, 16 and 20 are exposed from the respective first, second, third, fourth and fifth inner housings 13, 15, 17, 19 and 21. Here, the term "exposed" means that these portions can be viewed from the outside of the first, second, third, fourth and fifth inner housings 13, 15, 17, 19 and 21, and even in the case where the external connection portions of the terminals, used in the onboard connector 10, are of the female type, and are disposed within the respective inner housings, the external connection portions are exposed through respective insertion holes which are formed in the inner housings for the insertion of mating male terminals.

What is claimed is:

1. An onboard connector, comprising:

a plurality of terminals, each having an external connection portion and a board connection portion;

an inner housing, receiving the terminals, with the external connection portions and the board connection portions exposed; and an outer housing, having a mating connector-fitting through hole;

wherein the onboard connector is mounted on a circuit board; and the inner housing is fixed to the circuit board such that the board connection portions are electrically connected to the circuit board; and the outer housing is fixed to the circuit board such that the mating connector-fitting through hole is disposed in registry with the external connection portions exposed from the inner housing; and the inner housing and the outer housing are mounted on the circuit board such that the inner housing and the outer housing are disposed out of contact with each other.

2. The onboard connector according to claim 1, wherein the outer housing is fixed to the circuit board such that the external connection portions projecting from the inner housing, are disposed within the mating connector-fitting through hole.

3. The onboard connector according to claim 1, wherein the board connection portions of the terminals are formed into a surface-mounting type so as to be mounted on a surface of the circuit board.

* * * * *